US009516990B2

(12) United States Patent
Graute et al.

(10) Patent No.: US 9,516,990 B2
(45) Date of Patent: Dec. 13, 2016

(54) CUTLERY TRAY FOR A DISHWASHER

(75) Inventors: Bernhard Graute, Marienfeld (DE); Gregor Moch, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 193 days.

(21) Appl. No.: 12/640,563

(22) Filed: Dec. 17, 2009

(65) Prior Publication Data

US 2010/0155280 A1 Jun. 24, 2010

(30) Foreign Application Priority Data

Dec. 18, 2008 (DE) ..... 10 2008 062 761

(51) Int. Cl.

| | |
|---|---|
| ***A47G 19/08*** | (2006.01) |
| ***A47L 15/50*** | (2006.01) |
| *A47B 45/00* | (2006.01) |
| *A47B 88/04* | (2006.01) |

(52) U.S. Cl.

CPC ..... *A47L 15/502* (2013.01); *A47L 15/504* (2013.01); *A47B 45/00* (2013.01); *A47B 2088/0448* (2013.01); *A47L 15/501* (2013.01); *A47L 15/505* (2013.01)

(58) Field of Classification Search

CPC .... A47L 15/501; A47L 15/502; A47L 15/504; A47L 15/505; A47B 45/00; A47B 2088/0448

USPC ..... 211/41.8, 41.9, 41.1–41.6, 126.1, 175, 211/207, 133.2, 133.5, 126.9, 10, 126.8; 220/8, 528, 487, 488, 489, 23.88; 312/228, 311; 134/135; 206/553

See application file for complete search history.

(56) References Cited

U.S. PATENT DOCUMENTS

| | | | | |
|---|---|---|---|---|
| 1,406,773 | A * | 2/1922 | Stoffel | 211/41.3 |
| 1,925,371 | A * | 9/1933 | Charter | 211/153 |
| 3,018,002 | A * | 1/1962 | Glezen | 211/126.8 |
| 3,025,967 | A * | 3/1962 | Christophersen | 211/41.5 |
| 3,556,625 | A * | 1/1971 | Kauffman | 312/301 |
| 3,594,058 | A * | 7/1971 | Kauffman | 312/298 |
| D267,125 | S * | 11/1982 | Luoma | D32/56 |
| 4,553,523 | A * | 11/1985 | Stohrer, Jr. | 126/9 B |
| D291,646 | S * | 9/1987 | Koziol | D7/409 |
| 5,016,722 | A * | 5/1991 | Morita et al. | 180/89.14 |
| 5,016,772 | A * | 5/1991 | Wilk | 220/8 |
| 5,086,544 | A * | 2/1992 | Huttemann et al. | 211/41.8 |
| 5,626,242 | A * | 5/1997 | Weizer | 211/41.8 |
| 6,189,527 | B1 * | 2/2001 | Walsh et al. | 126/25 R |
| 6,341,704 | B1 * | 1/2002 | Michel, Jr. | 211/181.1 |
| 6,543,069 | B1 * | 4/2003 | Nelson | 4/656 |
| 7,182,210 | B2 * | 2/2007 | Metcalf | 211/175 |
| 7,445,128 | B2 * | 11/2008 | Kaczmarek | 211/41.8 |

(Continued)

FOREIGN PATENT DOCUMENTS

| | | |
|---|---|---|
| DE | 3721689 A1 | 1/1989 |
| DE | 4309915 A1 | 9/1994 |

(Continued)

OTHER PUBLICATIONS

European Search Report for EP09401040 mailed on Apr. 23, 2010.

*Primary Examiner* — Joshua J Michener
*Assistant Examiner* — Devin Barnett
(74) *Attorney, Agent, or Firm* — Leydig, Voit & Mayer, Ltd.

(57) ABSTRACT

A cutlery tray for a dishwasher includes a frame extendably disposed in a washing tub and a plurality of inserts movably disposed on the frame and adapted to hold dishware. The plurality or inserts include a first horizontally displaceable insert and at least one vertically displaceable insert.

13 Claims, 5 Drawing Sheets

(56) References Cited

U.S. PATENT DOCUMENTS

| | | | | |
|---|---|---|---|---|
| 7,455,066 | B2 * | 11/2008 | Feddema et al. | 134/56 D |
| 7,878,344 | B2 * | 2/2011 | Martin et al. | 211/153 |
| 2003/0173313 | A1 * | 9/2003 | Morgan | 211/41.11 |
| 2004/0134866 | A1 * | 7/2004 | Jerstroem et al. | 211/41.6 |
| 2004/0261824 | A1 * | 12/2004 | Eiermann | 134/57 D |
| 2005/0040120 | A1 * | 2/2005 | Pine et al. | 211/41.6 |
| 2005/0241682 | A1 * | 11/2005 | Jeong et al. | 134/56 D |
| 2006/0108298 | A1 * | 5/2006 | Kim | 211/41.8 |
| 2008/0072937 | A1 * | 3/2008 | Choi et al. | 134/137 |
| 2008/0083678 | A1 * | 4/2008 | Graute | 211/41.8 |
| 2008/0156362 | A1 * | 7/2008 | Shin et al. | 134/201 |
| 2009/0038657 | A1 * | 2/2009 | Kang | 134/137 |
| 2009/0090681 | A1 * | 4/2009 | Graute | 211/41.9 |
| 2009/0100591 | A1 * | 4/2009 | Lee et al. | 4/548 |
| 2010/0078048 | A1 * | 4/2010 | Schessl et al. | 134/115 R |
| 2010/0314977 | A1 * | 12/2010 | Mallory et al. | 312/228.1 |

FOREIGN PATENT DOCUMENTS

| | | | |
|---|---|---|---|
| DE | 19935312 | A1 | 2/2001 |
| DE | 102006055352 | A1 | 5/2008 |
| EP | 0901770 | A2 | 3/1999 |
| EP | 1072221 | A1 | 1/2001 |
| WO | WO 2008035866 | A1 | 3/2008 |

* cited by examiner

CUTLERY TRAY FOR A DISHWASHER

CROSS REFERENCE TO RELATED APPLICATIONS

Priority is claimed to German Patent Application No DE 10 2008 062 761.5-15, filed Dec. 18, 2008.

FIELD

The present invention relates to a cutlery tray for a dishwasher, including a frame extendably supported within a washing tub.

BACKGROUND

DE 3721689 A1 describes a cutlery tray that is formed by a flat basket-like framework having the base dimensions of a dish rack and is extendably supported within the washing tub of the dishwasher.

Such a cutlery tray may limit the space available for the placement of dishware in the dish rack located immediately therebelow. Due to the lack of vertical space, it may not be possible to place, for example, larger glasses in this rack.

Prior attempts to solve this problem have included providing cutlery trays that are formed by several sections removably disposed within a frame. However, this approach has the disadvantage that the space available for cutlery to be washed is reduced when individual sections are removed. This also reduces the ease-of-use, and sections that have been removed may be lost.

Documents DE 43 09 915 A1, DE 199 35 312 A1 and US 2005/0241682 A1 describe cutlery trays including inserts which are displaceable in the direction of withdrawal.

SUMMARY

An aspect of the present invention is to provide a cutlery tray that will allow larger dishware to be placed in the dish rack located immediately below the cutlery tray without reducing the space available for cutlery or reducing the ease-of-use.

In an embodiment, the present invention provides a cutlery tray for a dishwasher including a frame extendably disposed in a washing tub and a plurality of inserts movably disposed on the frame and adapted to hold dishware. The plurality of inserts include a first horizontally displaceable insert and at least one vertically displaceable insert.

BRIEF DESCRIPTION OF THE DRAWINGS

The present invention will be explained in more detail below with reference to exemplary embodiments and the accompanying drawings, in which.

DETAILED DESCRIPTION

Figure 3:
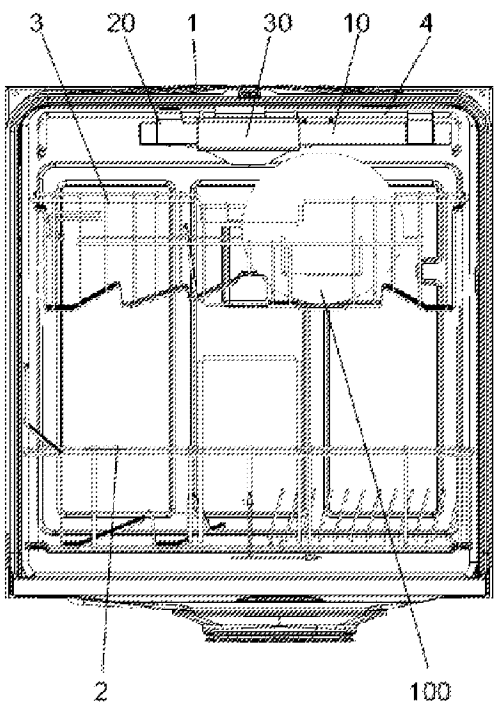
FIGS. 1 through 3 are schematic front views of an open washing tub of a dishwasher having a cutlery tray and two dish racks.

In an embodiment the present invention is related to a cutlery tray including a frame extendably supported within a washing tub and a plurality of inserts which are movably mounted on said frame and on which may be placed dishware items to be washed, especially cutlery, at least one of the inserts being mounted on the frame in such a way that it is horizontally displaceable.

In accordance with an embodiment of the present invention, the cutlery tray includes a frame extendably supported within the washing tub of the dishwasher and a plurality of inserts which are movably mounted on said frame and on which may be placed dishware items to be washed, especially cutlery, at least one of the inserts being mounted on the frame in such a way that it is horizontally displaceable, and at least one of the inserts being mounted on the frame in such a way that it is vertically displaceable. Displacement of an insert in a horizontal direction provides additional height fir the dish rack located therebelow so as to allow, for example, larger glasses to be placed in this dish rack. The displaceable insert remains in the dishwasher and, in addition, may be loaded so that the amount of space available for cutlery or small dishware, such as cups, egg cups, etc. is the same as when the insert is in the undisplaced position. Thanks to the vertically displaceable insert, is also possible to make room for large dishware items in the center of the dish rack located therebelow.

In accordance with an embodiment of the present invention, the horizontally displaceable insert is mounted on the frame in such a way that it is displaceable in a direction perpendicular to the direction of withdrawal of the cutlery tray. In this manner, room is made for a cup rack provided in the dish rack located therebelow. It is also convenient if two inserts are horizontally displaceably mounted on the frame. In order to enable the inserts to be displaced to a sufficient extent, the width of a horizontally displaceable insert may be between 30 percent and 45 percent, preferably 40 percent of the frame width. Thus, once the horizontally displaceable insert is displaced, even larger dishware items, such as plates, high pots, or the like, may be placed in the dish rack below the cutlery tray.

In particular, when a vertically displaceable insert is mounted between two horizontally displaceable inserts the space is divided, optimally, allowing for numerous variations. Such a combination allows the space within the washing tub of the dishwasher to be advantageously utilized.

To provide a simple means of displacing the inserts, the inserts are held at a from side and a rear side opposite the front side, respectively, by at least one hanger on a frame member extending perpendicularly to direction of withdrawal (X). In addition, the frame may have at least one support for supporting at least one of the inserts.

To provide a simple means of vertically displacing the corresponding insert, the hangers of the vertically displaceable insert have a hook-shaped portion for hooking on the frame members that extend perpendicularly to the direction of withdrawal of the cutlery tray, said hangers further having a guide portion including at least one guide pin which is insertable in corresponding guide grooves in a front plate and a rear plate of the vertically displaceable insert. For increased ease-of-use, the guide grooves are configured such that horizontal displacement of the hangers of the vertically displaceable insert will cause the insert to be raised or lowered in a vertical direction. To this end, the guide grooves may conveniently have an inclined, elongated central portion and two short, angled end portions.

In another embodiment, the hangers of the vertically displaceable insert can be displaced independently of each other on the frame members that extend perpendicularly to the direction of withdrawal of the cutlery tray. This allows the support plane of this insert to be adjusted to an inclined position, thereby providing an optimal space, for example, for gravy ladles or other cutlery items having a slender handle and a large-volume head portion.

Figure 2:
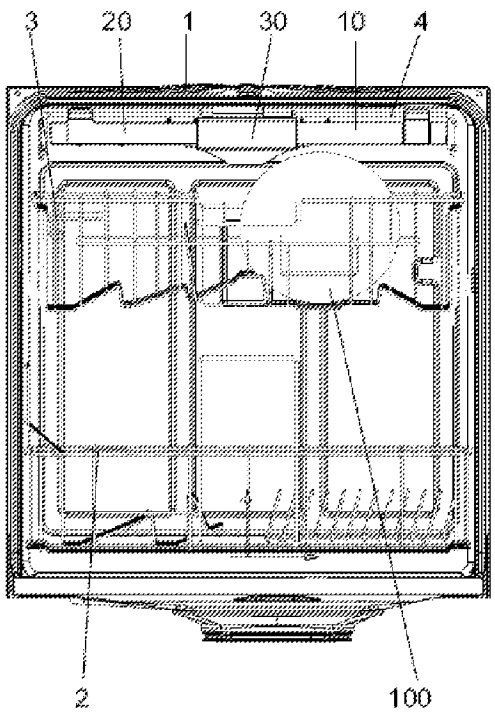
Figure 1:
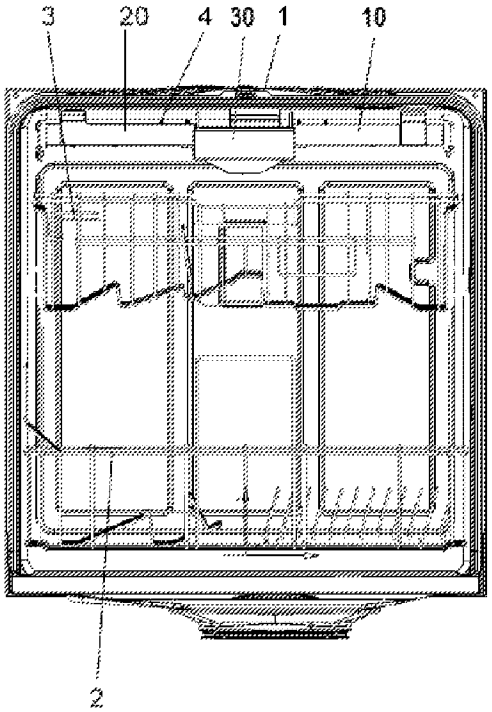

FIGS. 1 through 3 show the washing tub 1 of a dishwasher for washing, rinsing and drying dishes and cutlery. The washing tub is equipped with two extendable dish racks 2 and 3 and an also extendable cutlery tray 4. Racks 2 and 3, as well as cutlery tray 4, are associated in a known manner with spray devices in washing tub 1. Cutlery tray 4 is mounted within washing tub 1 above the upper dish rack 3, which is also referred to as upper rack. As shown in FIGS. 1 through 3, cutlery tray 4 has about the same dimensions in terms of its areal extent as dish racks 2 and 3 located therebelow, but is flatter than said racks.

Figure 4:
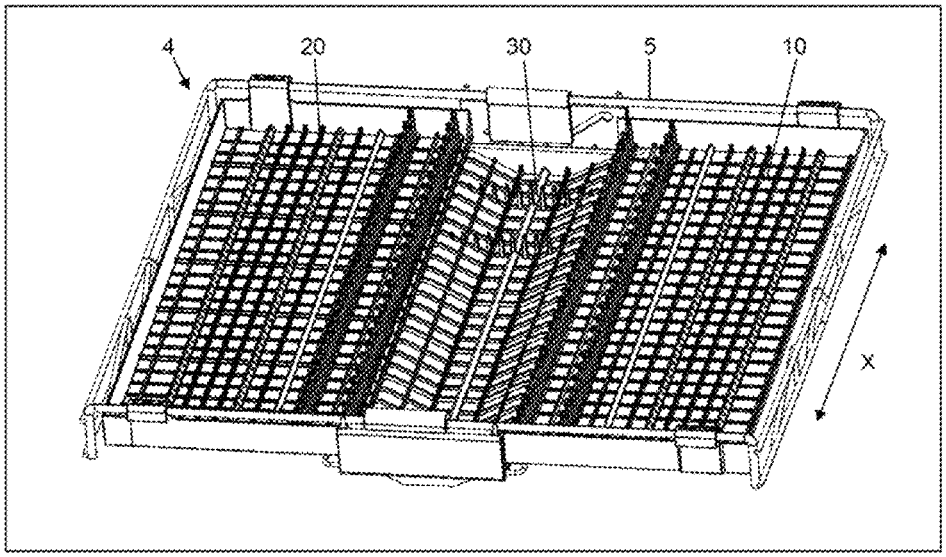
FIG. 4 is a perspective view of a cutlery tray.
Figure 5:
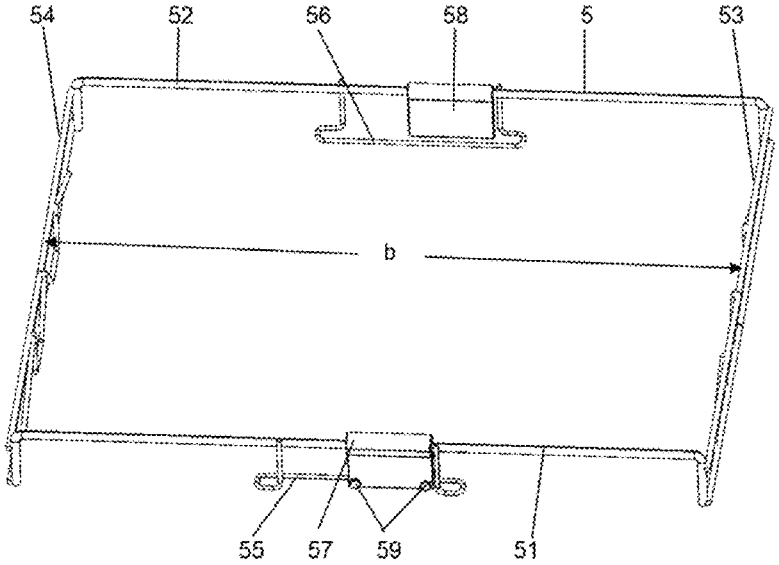
FIGS. 5 through 8 are detail views of the frame and the inserts of the cutlery tray.
Figure 6:
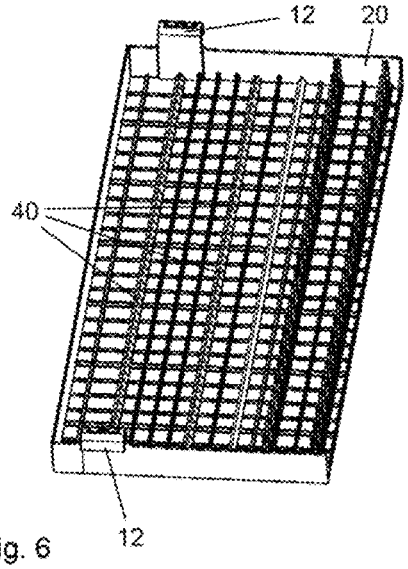
Figure 7:
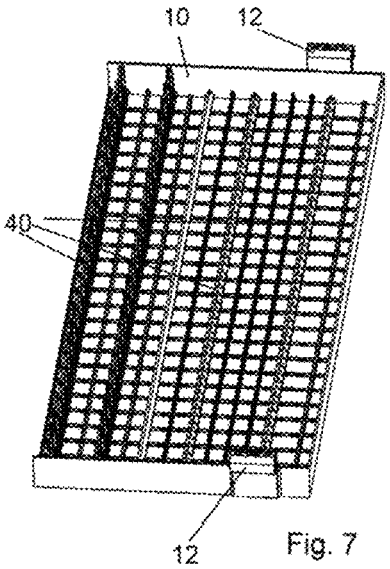
Figure 8:
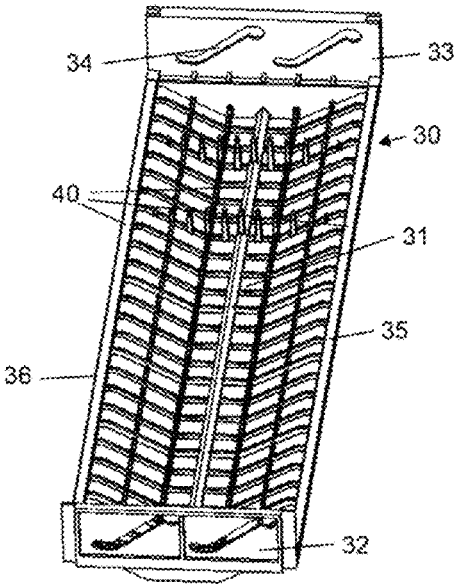
Figure 9:
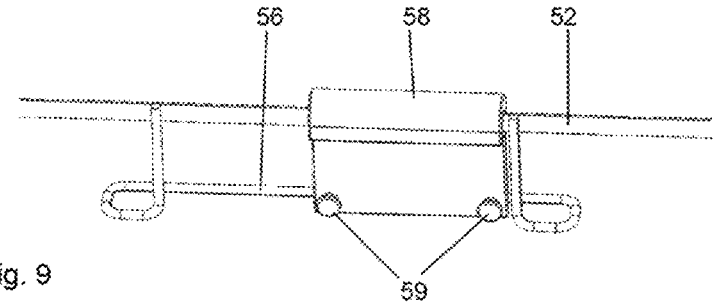
FIG. 9 is a detail view showing a hanger of a vertically displaceable insert mounted on the frame.

The design of cutlery tray 4 is illustrated in FIGS. 4 through 10. It has a frame 5 (see FIG. 5) which is made of plastic-coated metal wire and whose base dimensions are equal to those of a dish rack 2 or 3 located therebelow. Frame 5 is composed of two transverse braces 51 and 52 and two longitudinal, lattice-framework-like braces 53 and 54. Longitudinal braces 53 and 54 serve for attachment of rollers by which cutlery tray 4 is extendably supported on lateral pull-out guides within washing tub 1. The direction of withdrawal is indicated in FIG. 4 by the double arrow denoted X.

Two flat lateral inserts 10 and 20 (see FIGS. 6 and 7) are provided within frame 5 to receive cutlery. The lateral inserts are designed as plastic mesh inserts having wires 40 embedded therein by injection molding and are provided with holding bars 11 to allow separate placement of individual items of cutlery. At their outward ends, said inserts 10 and 20 are hung by two hooks 12 on the front and rear transverse braces 51 and 52 of the frame. The inward ends of inserts and 10 and 20 each rest on a front loop 55 and a rear loop 56 of frame 5. Loops 55 and 56 are attached to transverse braces 51 and 52. Due to the above-described mounting arrangement using hooks 12 and support loops 55 and 56, the two lateral inserts 10 and 20 are mounted on frame 5 in such a way that they are horizontally displaceable. This will be further discussed hereinbelow with reference to FIGS. 1 through 3 and 11 through 13.

Figure 10:
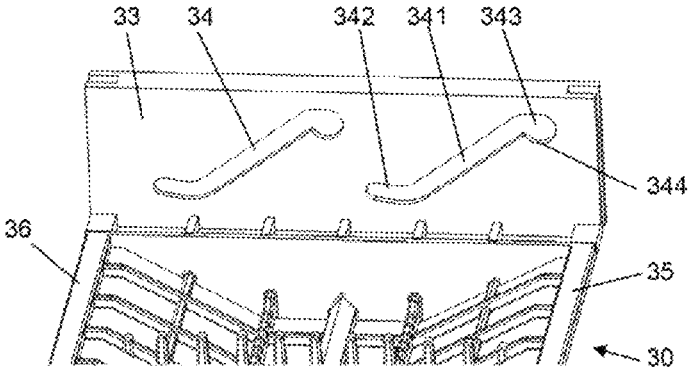
FIG. 10 is a detail view of a guide plate of a vertically displaceable insert.

A central insert 30 (see FIG. 8) is mounted between the two lateral inserts 10 and 20. The central insert, just as lateral inserts 10 and 20, is designed as a plastic mesh insert having wires 40 embedded therein by injection molding, but has a trapezoidal indentation 31 allowing larger cutlery items (serving ladles, etc.) to be received therein. Central insert 30 is attached to frame 5 by two hangers 57 and 58, which are slidably hung on transverse braces 51 and 52 between the ends of support loops 56 (see FIG. 9). Hangers 57 and 58 are each provided with two outwardly directed guide pins 59 which, in turn, are engaged in guide grooves 34 on a front plate 32 and a rear plate 33 of central insert 30 (see FIG. 10). As can be seen in FIG. 10, guide grooves 34 have an inclined, elongated central portion 341 and two short, nearly horizontal end portions 342 and 343. To ensure that guide pins 59 may remain in the respective end portions, lower end portions 342 are slightly inclined upwardly and upper end portions 343 have depressions 344. As a result of the above-described configuration of guide grooves 34 and their cooperation with guide pins 59, horizontal displacement of hangers 57 and/or 58 will cause central insert 30 to be raised or lowered (i.e., displaced) in a vertical direction. When displacing a hanger 57 and/or 58 to the left (FIG. 4), guide pins 59 move into lower end portions 342; i.e., the respective plate 33 and/or 34 of central insert 30 is raised. When displacing a hanger 57 and/or 58 to the right (FIG. 11), guide pins 59 move into upper end portions 343, lowering central insert 30. It is also possible for central insert 30 to be vertically displaced only in the front or rear portion thereof. This makes it possible to bring the central insert 30 into an inclined position in the direction of withdrawal of cutlery tray 4, thereby providing suitable space to accommodate, for example, a serving ladle or the like.

Figure 11:
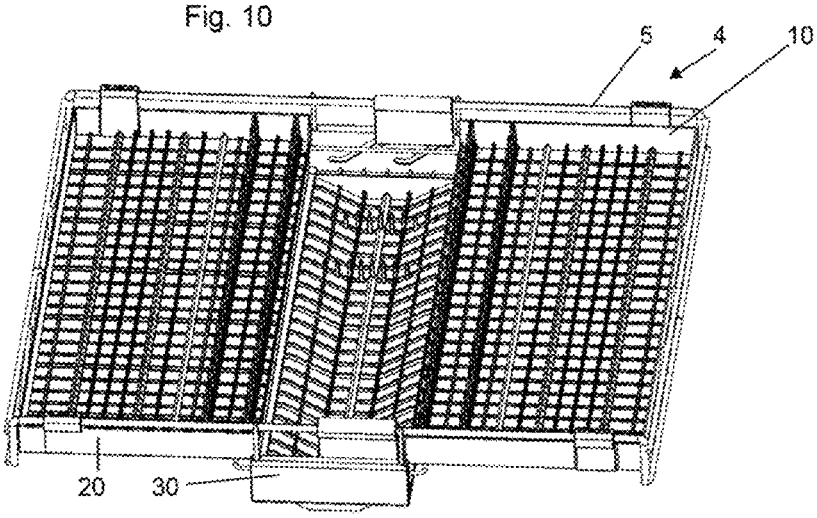
FIGS. 11 through 13 are perspective views of the cutlery tray, showing the inserts in different positions.
Figure 12:
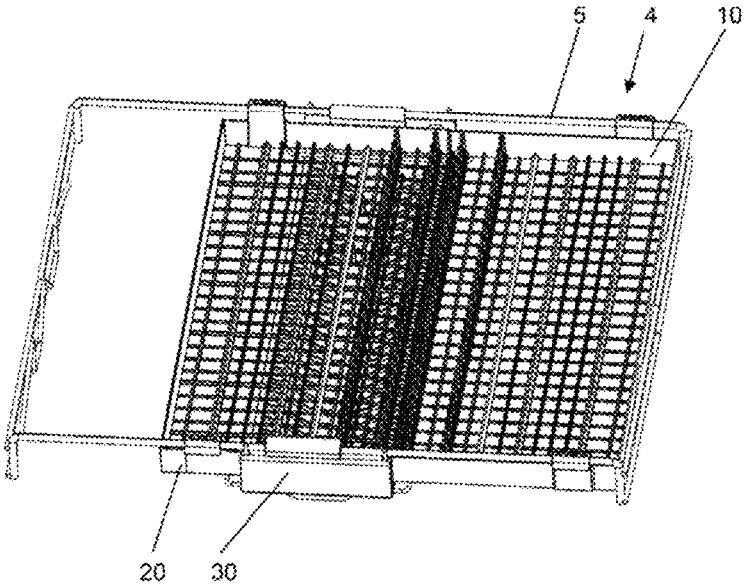
Figure 13:
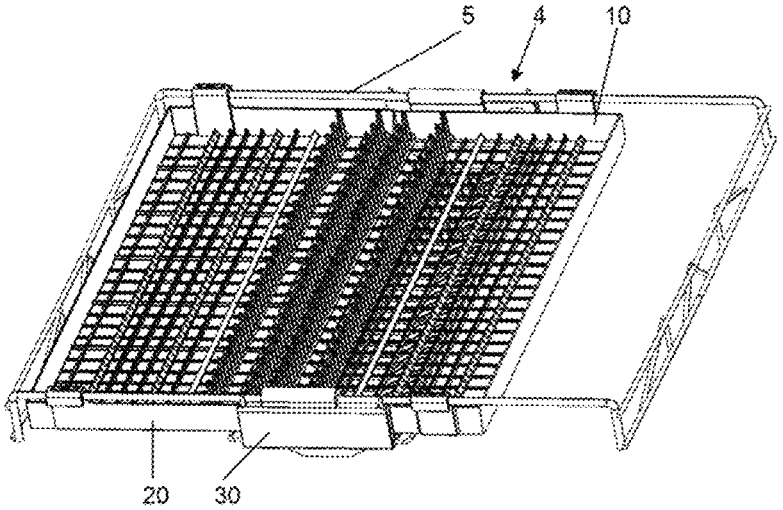

In FIGS. 1 through 3 and FIGS. 11 through 13, inserts 10, 20 and 30 are shown in different positions. FIGS. 1 and 11 show a cutlery tray 4 whose central insert 30 is lowered vertically. The space so provided is also suitable to allow small dishware, such as cups or egg cups, to be placed therein. In FIG. 2, central insert 30 is in a raised position. This allows large dishware items, such as the illustrated dish 100, to be placed in upper rack 3. FIGS. 3 and 12 show a variant where left lateral insert 20 has been moved toward the center over central insert 30. In this position, the two lateral inserts 10 and 20 are adjacent and in direct contact with one another. In this manner, more space is created in the left portion of upper rack 3 for placement of items therein, which allows washing of tall champagne or wine glasses, for example. In FIG. 13, right lateral insert 10 has been moved over central insert 30.

To provide sufficient space in upper rack 3, the space made available by the displacement must be about 20 percent of the total loading area of upper rack 3. This is achieved by selecting the width of each of the horizontally displaceable inserts to be about 40 percent of frame width b (see FIG. 5).

To eliminate the need to remove central insert 30 to allow displacement of lateral inserts 10 and 20, the two lateral edges 35 and 36 of the central insert are located below support loops 55 and 56 even in the raised position (FIGS. 1 and 4).

While the invention has been particularly shown and described with reference to preferred embodiments thereof, it will be understood by those skilled in the art that various changes in form and details may be made therein without departing from the spirit and scope of the invention

What is claimed is:

1. A dishwasher comprising:

a washing tub;

a dish rack disposed in the washing tub: and a cutlery tray disposed above the dish rack, the cutlery tray including:

a frame extendably disposed so as to be movable into and out of the washing tub;

a plurality of inserts movably disposed on the frame and adapted to hold dishware, the plurality of inserts including:

a first horizontally displaceable insert mounted on the frame, and at least one vertically displaceable insert that is mounted on the frame by guiding elements, wherein the guiding elements are removably attached to the frame, wherein the at least one vertically displaceable insert is vertically displaceable relative to the first horizontally displaceable insert between a raised position in engagement with the guiding elements while the guiding elements are attached to the frame and slides along the guiding elements to a lowered position in engagement with the guiding elements while the guiding elements are attached to the frame, wherein the first horizontally displaceable insert is movable from a first position within the frame that is adjacent to the at least one vertically displaceable insert into a second position within the frame that is under or over the vertically displaceable insert, wherein, when the first horizontally displaceable insert is at the first position, a first vertical free distance is provided above a first portion of the dish rack disposed below the first position, and, wherein, when the first horizontally displaceable insert is at the second position, a second vertical free distance is provided above the first portion of the disk rack, the second vertical free distance being greater than the first vertical free distance.

2. The dishwasher as recited in claim 1, wherein the plurality of inserts includes a second horizontally displaceable insert.

3. The dishwasher as recited in claim 1, wherein a width of the first horizontally displaceable insert is between 30 percent and 45 percent of a width of the frame.

4. The dishwasher as recited in claim 2, wherein a width of the first horizontally displaceable insert is between 30 percent and 45 percent of a width of the frame.

5. The dishwasher as recited in claim 3, wherein the width of the first horizontally displaceable insert is about 40 percent of the width of the frame.

6. The dishwasher as recited in claim 2, wherein a width of each of the first and second horizontally displaceable insert is between 30 percent and 45 percent of a width of the frame.

7. The dishwasher as recited in claim 2, wherein the vertically displaceable insert is disposed on the frame between the first and second horizontally displaceable inserts.

8. The dishwasher as recited in claim 1, wherein the guide elements are connected to a first set of hangers; wherein the horizontal insert is connected to a second set of hangers; wherein each of the plurality of inserts is held by a respective set of hangers at a respective front side and rear side opposite the front side on a frame member of the frame, the respective frame members extending perpendicularly to a withdrawal direction of the cutlery tray from the washing tab.

9. The dishwasher as recited in claim 1, wherein the frame includes at least one support for supporting at least one of the plurality of inserts.

10. The dishwasher as recited in claim 1, wherein the dishware includes cutlery.

11. A cutlery tray for a dishwasher comprising:

a frame extendably disposed in a washing tub;

a plurality of inserts movably disposed on the frame and adapted to hold dishware, the plurality of inserts including:

a first horizontally displaceable insert mounted on the frame, and at least one vertically displaceable insert that is displaceably mounted on the frame so as to be disposable at a raised position and at a lowered position on the frame, and respective front and rear hangers associated with the vertically displaceable insert, each hanger including:

a hook-shaped portion adapted to hook onto respective front and rear frame members of the frame, the frame members extending perpendicularly to the withdrawal direction of the cutlery tray from the washing tub, and a guide portion including at least one guide pin, wherein the vertically displaceable insert includes respective front and rear plates, each plate including a guide groove adapted to receive a corresponding guide pin of the guide portion of the respective hanger, wherein the guide grooves are configured such that a horizontal displacement of the respective hangers corresponds to vertical raising and lowering of the vertically displaceable insert.

12. The cutlery tray as recited in claim 11, wherein the guide grooves include an inclined, elongated, central portion and a first and a second short, angled end portion.

13. The cutlery tray as recited in claim 11, wherein the front and rear hangers are independently displaceably disposed on the respective frame members.

* * * * *